US009825431B2

(12) United States Patent
Kosuge et al.

(10) Patent No.: US 9,825,431 B2
(45) Date of Patent: Nov. 21, 2017

(54) IGNITION DEVICE

(71) Applicant: DENSO CORPORATION, Kariya, Aichi-pref. (JP)

(72) Inventors: Hideaki Kosuge, Seto (JP); Shinichi Okabe, Aichi-ken (JP); Akimitsu Sugiura, Nagoya (JP)

(73) Assignee: DENSO CORPORATION, Kariya (JP)

( * ) Notice: Subject to any disclaimer, the term of this patent is extended or adjusted under 35 U.S.C. 154(b) by 309 days.

(21) Appl. No.: 14/554,763

(22) Filed: Nov. 26, 2014

(65) Prior Publication Data

US 2015/0144115 A1 May 28, 2015

(30) Foreign Application Priority Data

Nov. 28, 2013 (JP) ..... 2013-245866

(51) Int. Cl.

| | |
|---|---|
| ***H01T 13/20*** | (2006.01) |
| ***H01T 13/32*** | (2006.01) |
| ***H01T 13/08*** | (2006.01) |
| ***H01T 13/52*** | (2006.01) |
| ***H01T 13/50*** | (2006.01) |
| *F02P 23/04* | (2006.01) |

(52) U.S. Cl.

CPC ..... *H01T 13/20* (2013.01); *H01T 13/08* (2013.01); *H01T 13/32* (2013.01); *H01T 13/50* (2013.01); *H01T 13/52* (2013.01); *F02P 23/045* (2013.01)

(58) Field of Classification Search

CPC ..... H01T 13/20; H01T 13/03; H01T 13/50; H01T 13/08; H01T 13/52; F02P 23/045

See application file for complete search history.

(56) References Cited

U.S. PATENT DOCUMENTS 4,092,558 A * 5/1978 Yamada ..... H01T 13/52 313/131 R
4,476,412 A * 10/1984 Nishida ..... H01T 13/38 313/130
4,730,582 A * 3/1988 Lindsay ..... F02P 15/08 123/169 EL (Continued)

FOREIGN PATENT DOCUMENTS

JP 2007-278279 10/2007
JP 2010-037949 2/2010

*Primary Examiner* — David Hamaoui
(74) *Attorney, Agent, or Firm* — Nixon & Vanderhye P.C.

(57) ABSTRACT

An ignition device includes a center electrode, a center dielectric covering the center electrode, a ground electrode disposed so as to form a discharge space with the center dielectric, and a high energy source for applying an AC voltage between the center electrode and the ground electrode to generate a streamer discharge. A distal end portion of the center electrode projects beyond a distal end of the ground electrode to an inside of the combustion chamber of an internal combustion engine to make a dielectric discharge portion. The ground electrode is formed with an airflow inlet and en airflow outlet at a lateral portion thereof for enabling an in-cylinder airflow to be introduced into the discharge space. A distal end portion of the ground electrode projects radially inward to make a ground electrode projecting portion so that a discharge space narrow portion is formed with the dielectric discharge portion.

9 Claims, 19 Drawing Sheets

(56) References Cited

U.S. PATENT DOCUMENTS

| | | | | |
|---|---|---|---|---|
| 5,469,013 | A * | 11/1995 | Kang | H01T 13/50 313/128 |
| 5,950,584 | A * | 9/1999 | Bubeck | H01T 13/32 123/169 E |
| 6,531,809 | B1 * | 3/2003 | Benedikt | H01T 13/52 313/131 R |
| 9,112,334 | B2 * | 8/2015 | Farrell | H01T 13/26 |
| 9,267,474 | B2 * | 2/2016 | Abe | F02P 23/045 |
| 9,391,431 | B2 * | 7/2016 | Okabe | H01T 13/467 |
| 9,444,229 | B2 * | 9/2016 | Kinoshita | H01T 13/32 |
| 2009/0126684 | A1 * | 5/2009 | Shiraishi | F02D 41/3041 123/406.12 |
| 2010/0133976 | A1 * | 6/2010 | Siegel | H01T 13/20 313/141 |
| 2016/0079739 | A1 * | 3/2016 | Okazaki | H01T 13/08 313/143 |

* cited by examiner

SECOND EMBODIMENT

SECOND EMBODIMENT

THIRD EMBODIMENT

THIRD EMBODIMENT

FOURTH EMBODIMENT

FOURTH EMBODIMENT

FIFTH EMBODIMENT

FIFTH EMBODIMENT

SIXTH EMBODIMENT

SIXTH EMBODIMENT

SEVENTH EMBODIMENT

SEVENTH EMBODIMENT

EIGHTH EMBODIMENT

EIGHTH EMBODIMENT

NINTH EMBODIMENT

NINTH EMBODIMENT

IGNITION DEVICE

This application claims priority to Japanese Patent Application 2013-245866 filed on Nov. 28, 2013, the entire contents of which are hereby incorporated by reference.

BACKGROUND OF THE INVENTION

1. Field of the Invention

The present invention relates to an ignition device that can be used for an internal combustion engine having difficult ignitability.

2. Description of Related Art

In recent years, compact and low-$NO_x$ high efficiency engines are being developed to address the demand of increase of fuel economy and reduction of $CO_2$. High efficiency engines are difficult to ignite by sparking because they are highly supercharged and highly compressed engines which are often supplied with lean air-fuel mixture. Accordingly, there is a demand for an ignition device excellent in burning velocity and ignitability.

Japanese Patent Application Laid-open No. 2010-37949 describes a barrier discharge device for an internal combustion engine, which includes a first electrode, a second electrode surrounding the first electrode and a dielectric covering at least one of the first and second electrodes, the discharge gap between the dielectric and the other of the first and second electrodes varying in length depending on the longitudinal position of the electrodes.

However, the barrier discharge device as described in the above patent document has a problem in that the anti-inflammatory effect thereof is large causing the ignitability to be unstable, because the discharge space is formed receding radially inward greatly from the distal end of the ground electrode so that the distal end of the center dielectric is hardly exposed from the ground electrode.

Further, when a strong in-cylinder airflow is generated within a combustion chamber to promote agitation of an air-flow mixture to thereby further increase fuel economy for a lean-burn engine, if the barrier discharge device does not project to the inside of the combustion chamber at all as is the case with the above patent document, the in-cylinder airflow flows over the surface of the discharge section without reducing its speed. As a result, since a strong dragging force acts on the discharge space, radicals generated by a barrier discharge spread in the combustion chamber before they generate a flame kernel in the discharge space, preventing a volume ignition.

SUMMARY

An exemplary embodiment provides an ignition device for an internal combustion engine including:

a columnar center electrode;

a center dielectric having a shape of a bottomed cylinder and covering the center electrode;

a housing accommodating therein the center dielectric;

a ground electrode disposed at a distal end of the housing so as to form a discharge space with the center dielectric; and a high energy source for applying an AC voltage of a predetermined frequency between the center electrode and the ground electrode so that an AC electric field is formed between the center electrode covered by the center dielectric and the ground electrode to generate a streamer discharge for igniting an air-fuel mixture introduced into a combustion chamber of the internal combustion engine; wherein a distal end portion of the center electrode covered by the center dielectric projects beyond a distal end of the ground electrode to an inside of the combustion chamber to make a dielectric discharge portion exposed in the discharge space, the ground electrode is formed with an airflow inlet and an airflow outlet at a lateral portion thereof for enabling an in-cylinder airflow flowing in the combustion chamber to be introduced into the discharge space, and a distal end portion of the ground electrode projects radially inward to make a ground electrode projecting portion so that a discharge space narrow portion is formed with the dielectric discharge portion.

According to the exemplary embodiment, there is provided an ignition device that can increase a lean limit air-fuel ratio of an internal combustion engine having difficult ignitability.

Other advantages and features of the invention will become apparent from the following description including the drawings and

PREFERRED EMBODIMENTS OF THE INVENTION

Figure 1A:
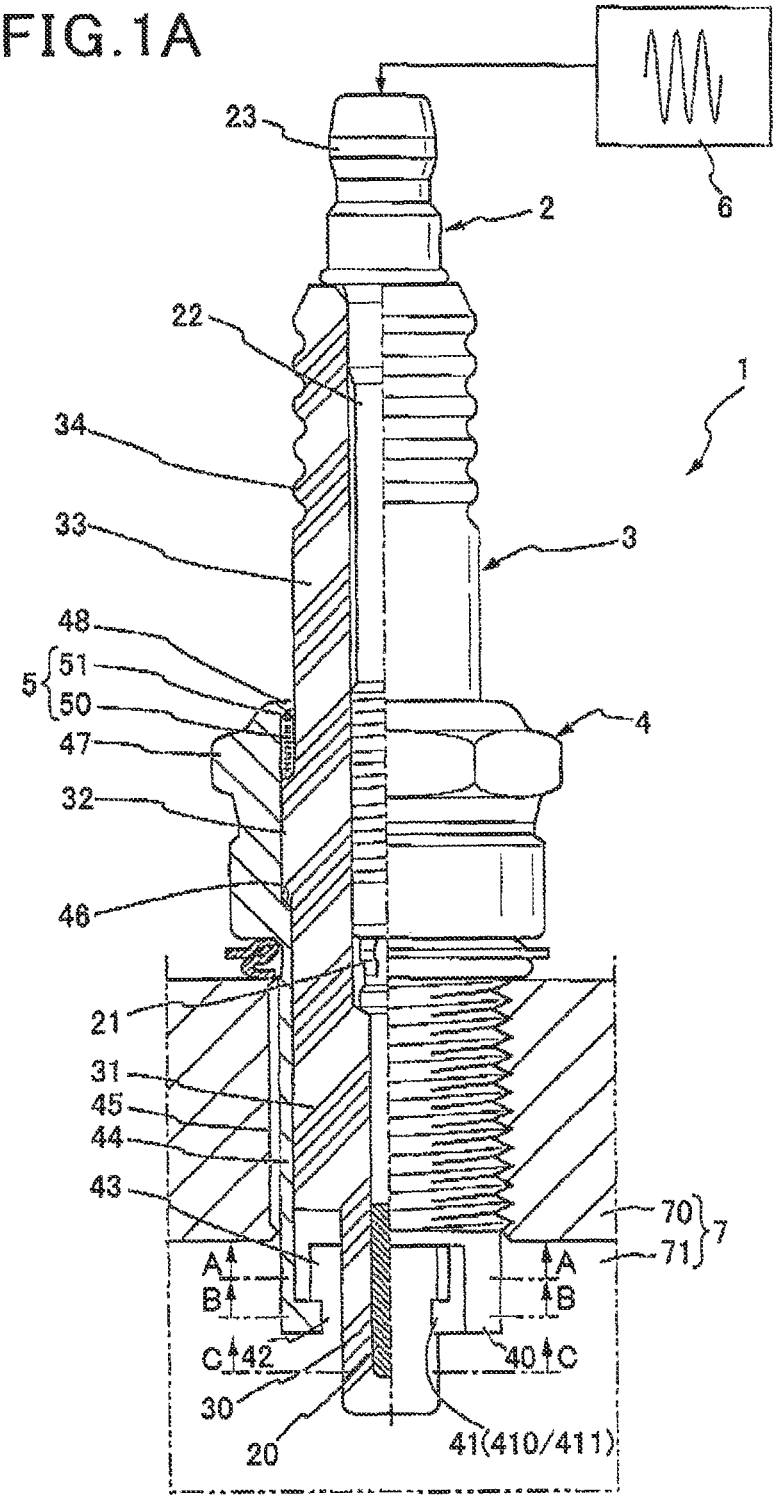
FIG. 1A is a half cross-sectional view of an ignition device 1 according a first embodiment of the invention.

An ignition device 1 according to a first embodiment of the invention is described with reference to FIGS. 1A, 1B, 1C and 1D. The ignition device 1 is a device for igniting an air-fuel mixture introduced into a combustion chamber 71 of an internal combustion engine 7. The ignition device 1 is mounted on an engine block 70 of the internal combustion engine 7 such that its distal end is exposed to the inside of the combustion chamber 71.

The ignition device 1 includes a columnar center electrode 2, a center dielectric 3 having a shape of a bottomed cylinder covering the center electrode 2, a tubular housing 4 housing therein the center dielectric 3, a ground electrode 40 disposed at the distal end of the housing 4 so as to form a discharge space 43 with the center dielectric 3, and a high energy power source 6 for applying a high AC voltage of a predetermined frequency between the center electrode 2 and the ground electrode 40. The high energy power source 6 forms a high frequency electric field between the center electrode 2 insulated by the center dielectric 3 and the ground electrode 40, to thereby generate a streamer discharge between the surface of the center dielectric 3 covering the center electrode 2 and the ground electrode 40 without causing an arc discharge. As described later, this embodiment has a structure to enable generating easily a streamer discharge in the vicinity of combustion chamber 71, and moving the generated streamer discharge using the in-cylinder airflow without causing blowoff, so that a flame growth is promoted to achieve stable ignitability.

The center electrode 2 covered by the center dielectric 3 is disposed such that its distal end projects beyond the distal end of the ground electrode 40 toward the inside of the combustion chamber 71. The ground electrode 40 is notched at its lateral side to have an airflow inlet 400 and an airflow outlet 401 for enabling the in-cylinder airflow flowing within the combustion chamber 71 to pass through the discharge space 43. The ground electrode 40 is formed with a pair of ground electrode projecting portions 41 projecting radially inward at a part of its distal end portion.

The center dielectric 3 is formed with a dielectric discharge portion 30 exposed to the discharge space 43. A discharge space narrow portion 42 is provided between the dielectric discharge portion 30 and the ground electrode 40. As shown in FIG. 1B, the ground electrode projecting portion 41 includes an inlet flow-straightening surface 410 formed to have a tapered shape so that the discharge distance (the distance between the ground electrode projecting portion 41 and the dielectric discharge portion 30) decreases gradually toward the upstream of the in-cylinder airflow. The discharge distance takes the minimum value of Gmin at the discharge space narrow portion 42. The ground electrode projecting portion 41 further includes an outlet flow-straightening surface 411 located, downstream from the discharge space narrow portion 42, which is formed to have a curved shape so that the discharge distance increases gradually in a continuous manner toward the upstream side of the in-cylinder airflow.

The center electrode 2, which is made of heat-resistant metal material having a high electrical conductivity such as iron, nickel or alloy of them, includes a center electrode discharge portion 20, a center electrode connecting portion 21, a center electrode center axis portion 22 and a center electrode terminal portion 23. The center electrode discharge portion 20 may contain a highly conductive material such as copper. In this embodiment, the center electrode discharge portion 20, the center electrode connecting portion 21, the center electrode center axis portion 22 and the center electrode terminal portion 23 are formed separately from one another. However, they may be formed integrally. The center electrode connecting portion 21 may have noise suppression resistance property.

The center dielectric 3, which is formed in a shape of a bottomed cylinder, is made of highly heat-resistive dielectric material such as alumina or zirconia. The center dielectric 3 is disposed so as to cover the center electrode discharge portion 20 located at the distal side of the center electrode 20 to ensure insulation between the center electrode 2 and the ground electrode 40. The center electrode terminal portion 23 is exposed from the proximal side of the center dielectric 3 to be connected to the high energy power source 6.

The dielectric discharge portion 30 is provided at the distal side of the center dielectric 3 so as to cover the center electrode 2. A dielectric proximal portion 31 is provided at the middle side of the center dielectric 3 so as to define the discharge space 43 with the ground electrode 40 and hold the center electrode 2 thereinside. A dielectric diameter-expanded portion 32 is provided at the middle side of the center dielectric 3 so as to expand the outer periphery of the dielectric proximal portion 31 to enable fixing of the center dielectric 3 in the housing 4. A tubular dielectric head portion 33 is provided on the proximal side of the center dielectric 3 so as to be exposed from the distal side of the housing 4 to ensure insulation between the center electrode terminal portion 23 and the housing 4. The dielectric head portion 33 may be formed with a corrugation 34 to increase the creepage distance with the center electrode terminal portion 23.

The housing 4 is made of metal material such as iron, nickel or stainless steel in a tubular shape. The housing 4 includes the ground electrode 40, the ground electrode projecting portions 41, a housing tubular portion 44, a thread portion 45, a dielectric locking portion 46, a housing proximal portion 47 and a swage portion 48.

The discharge space 40 is defined by the inner periphery of the ground electrode 40 and the inner periphery of the dielectric discharge portion 30. The ground electrode 40 is formed with then airflow inlet 400 and the airflow outlet 401. The ground electrode projecting portion 41 is provided at the distal side of the ground electrode 40. The ground electrode projecting portion 41 is formed with the inlet flow-straightening surface 410 and the outlet flow-straightening surface 411.

Between the ground electrode projecting portion 41 and the dielectric discharge portion 30, there is formed the discharge space narrow portion 42 in this embodiment, the pair of the ground electrode projecting portions 41 are disposed such that they are symmetric with respect to the imaginary plane including the center axis C/L of the center electrode 20.

The housing tubular portion 44 houses the dielectric proximal portion 31 therein, and is formed with the thread portion 45 at its outer periphery. The thread portion 45 is disposed at the engine head 70 for screwing the ignition device 1 such that the ground electrode 40, the ground electrode projecting portion 41 and the dielectric discharge portion 30 face the inside of the combustion chamber 71 through a plug hole 701 cut in the engine head 70. The dielectric locking portion 46 locks the dielectric diameter-expanded portion 32. The swage portion 48 applies an axial force to the dielectric diameter-expanded portion 32 through a seal 5 made of powder filling material 50 such as talc or a sealing member 51 such as a metal packing to airtightly hold the center dielectric 3. The housing proximal portion 47 is formed with a hexagon portion at its outer periphery for screwing the thread portion 45 to the engine head 70.

The high energy power source 3 generates an AC voltage of ±20 kV to 50 kV, for example, and a frequency from 0 kHz to 850 kHz, for example, at a predetermined timing in accordance with the operating condition of the internal combustion engine. A portion of the ground electrode projecting portion 41, which is the closest to the dielectric discharge portion 30, serves as an electric field concentration portion $P_{EFC}$ at which a streamer discharge occurs most easily.

Next, advantages of the ignition device 1 described above are explained with reference to FIGS. 2A, 2B, 2C, 2D, 3A and 3B. As shown in FIG. 2A, the in-cylinder airflow in the cross section along line AA of FIG. 1A flows into the discharge space 43 from the airflow inlet 400 formed by cutting the tubular ground electrode 40, divides into two streams when colliding with the surface of the center dielectric 30, passes between the inner periphery of the ground electrode 40 and the surface of the dielectric discharge portion 30, and exits out of the discharging space 43 from the airflow outlet 401. When the in-cylinder airflow collides with the surface of the dielectric discharge portion 30, its speed is reduced. Also, Karman vortices are formed in the space hidden by the dielectric discharge portion 30.

Figure 1B:
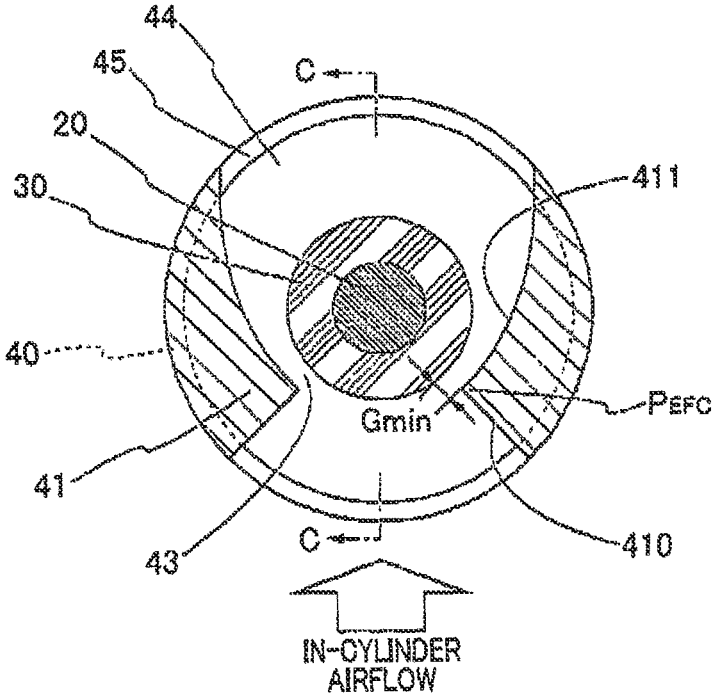
FIG. 1B is a lateral cross-sectional view of FIG. 1A taken along line B-B.
Figure 1C:
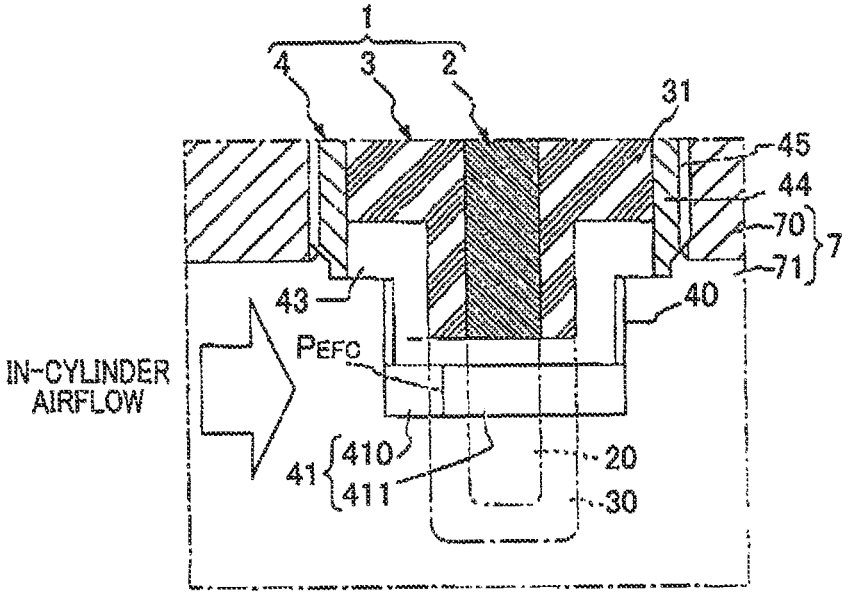
FIG. 1C is a longitudinal cross-sectional view of FIG. 1B taken along line C-C.
Figure 1D:
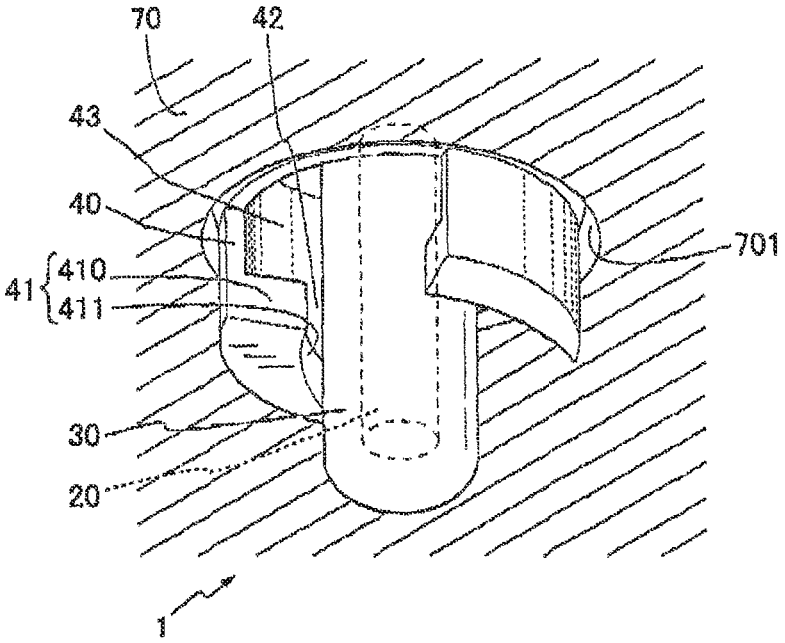
FIG. 1D is a perspective view of the distal end of the ignition device 1 according to the first embodiment as viewed from the side of a combustion chamber.
Figure 2A:
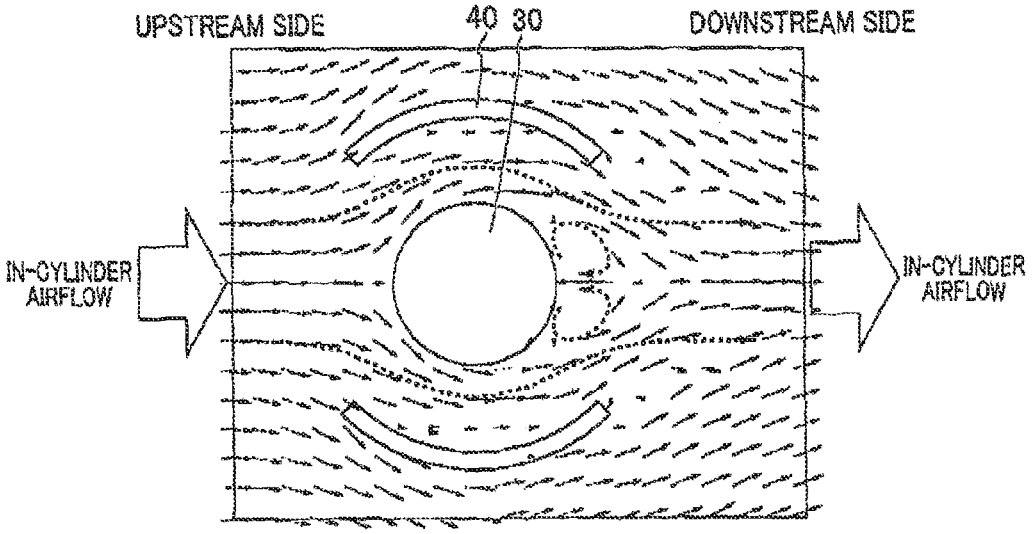
FIG. 2A is an analysis diagram showing an airflow in the lateral cross section along line A-A of FIG. 1A.
Figure 2B:
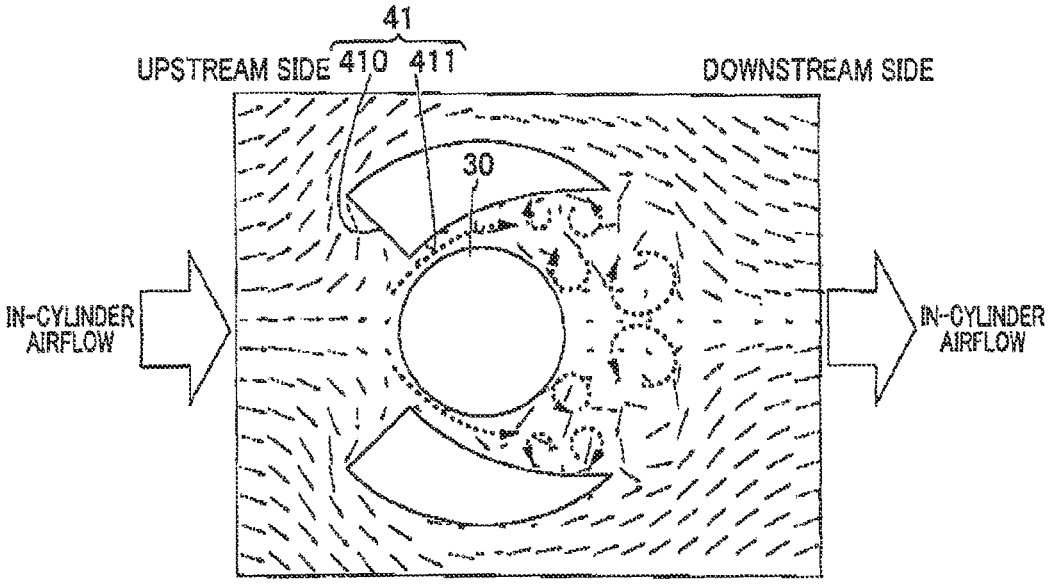
FIG. 2B is an analysis diagram showing the airflow in the lateral cross section along line B-B of FIG. 1A.
Figure 2C:
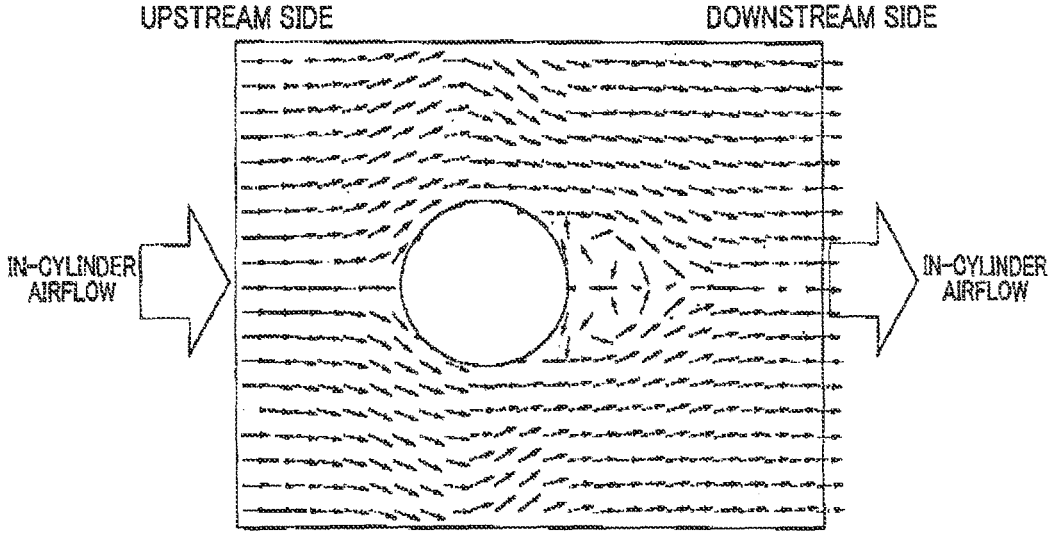
FIG. 2C is an analysis diagram showing then airflow in the lateral cross section along line C-C of FIG. 1A.
Figure 2D:
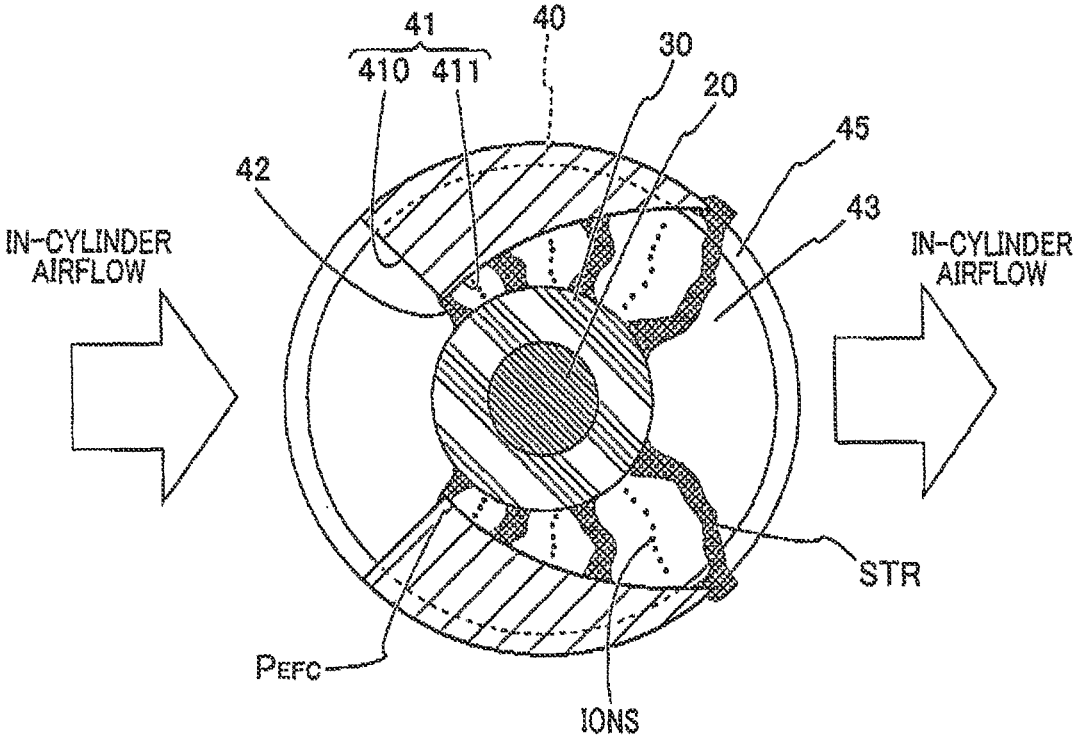
FIG. 2D is a schematic diagram showing the airflow in longitudinal cross section along line CC of FIG. 1B.

As shown in FIG. 2E, the in-cylinder airflow in the cross section along line B-B of FIG. 1A collides with the inlet flow-straightening surface 410 of the ground electrode projecting portion 41 and the surface of the dielectric discharge portion 30 to be straightened, and passes the discharge space narrow portion 42 in a state of being restrained in flow velocity and flow rate. Since the distance between the outlet flow-straightening surface 411 and the surface of the dielectric discharge portion 30 increases gradually toward the downstream side, the flow velocity is further reduced and vortices are formed. As shown in FIG. 2C, the in-cylinder airflow in the cross section along line C-C of FIG. 1A is divided into two parts when colliding with the surface of the center dielectric 30 and flows toward the downstream side. Since the ground electrode 40 is not present in the cross section along line C-C of FIG. 1B, the flow velocity in the cross section along line C-C is relatively large. Accordingly, as shown in FIG. 2D, the flow velocity VB of the airflow passing the discharge space narrow portion 42 along the surface (410, 411) of the ground electrode projecting portion 41 is smaller than the flow velocity VA of the airflow flowing through the discharge space 43, and the flow velocity VC of the airflow passing the dielectric discharge portion 30 projecting beyond the ground electrode 40 becomes the largest, as a result of which vortices vertical to the airflow passing the discharge space narrow portion 42 are also formed.

Figure 3A:
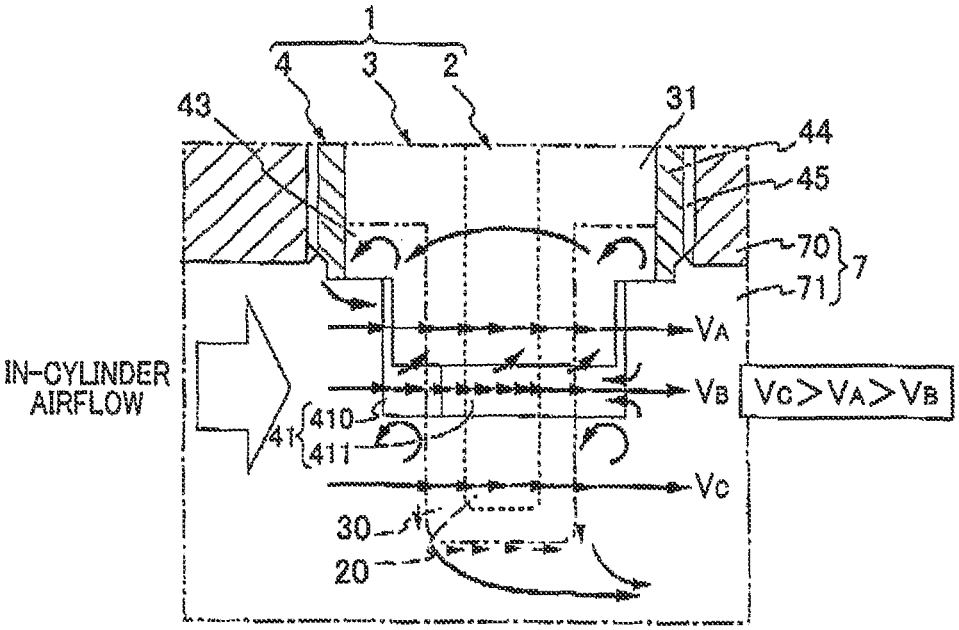
FIG. 3A is a schematic diagram showing a barrier discharge in the lateral cross section along line B-B of FIG. 1A.
Figure 3B:
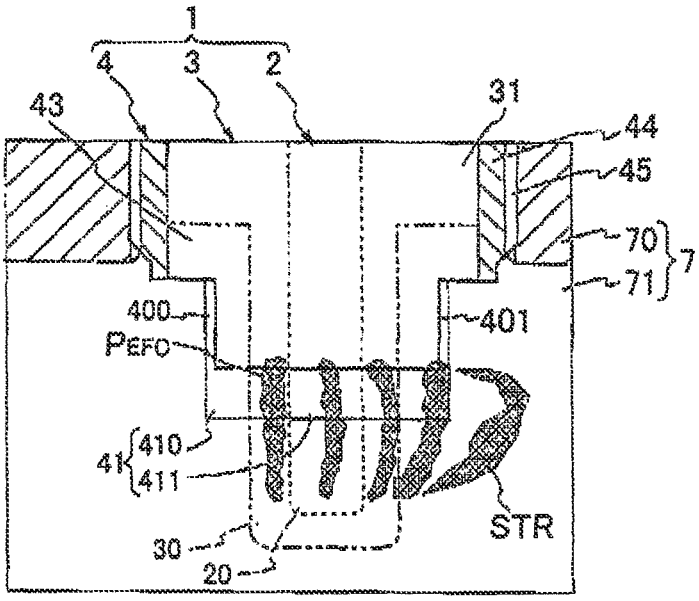
FIG. 3B is a schematic diagram showing the barrier discharge in the longitudinal cross section along line C-C of FIG. 1B.

When the high frequency voltage is applied between the center electrode 2 and the ground electrode 40 by the high energy power source 6, as shown in FIG. 3B, a streamer discharge STR is generated at a position at which the electric field becomes the highest, and ions are formed around this position. At this time, since the center electrode discharge portion 20 projects beyond the ground electrode 40 toward the combustion chamber 71, and accordingly the electric field becomes the highest at its distal portion, the streamer discharge STR is formed so as to extend from the discharge space narrow portion 42 to the distal side.

The streamer discharge STR formed in this way is subjected to the action of the in-cylinder airflow passing the dielectric discharge portion 30 projecting beyond the ground electrode 40, as a result of which the streamer discharge STR moves toward the downstream side. At this time, a flame kernel grows by reaction with the air-fuel mixture present in the combustion chamber 71. Further, since vortices are being formed around the ground electrode projecting portion 41, agitation between the flame kernel and the air-fuel mixture is promoted to increase the speed of the flame growth.

Figure 4A:
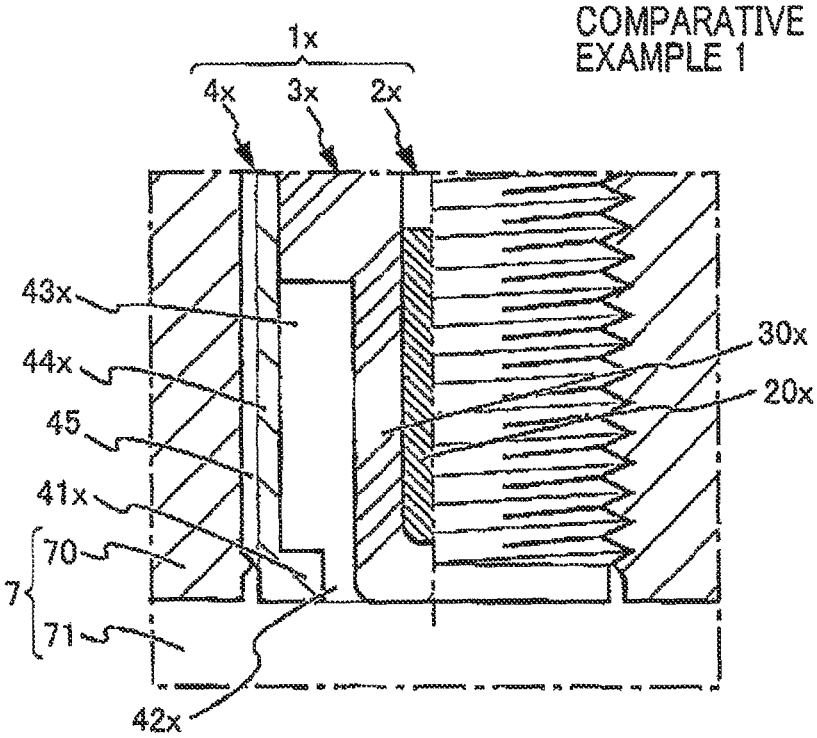
FIG. 4A is a longitudinal cross-sectional view of an ignition device 1*x* as comparative example 1.
Figure 4B:
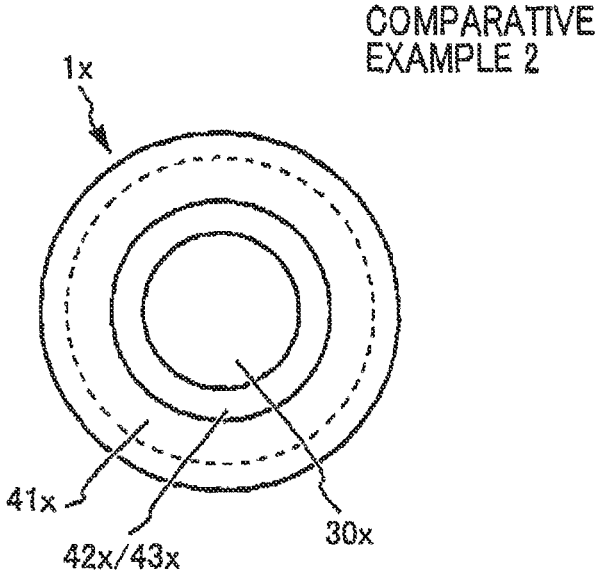
FIG. 4B is a bottom view of the ignition device 1*x* as comparative example 1.
Figure 5A:
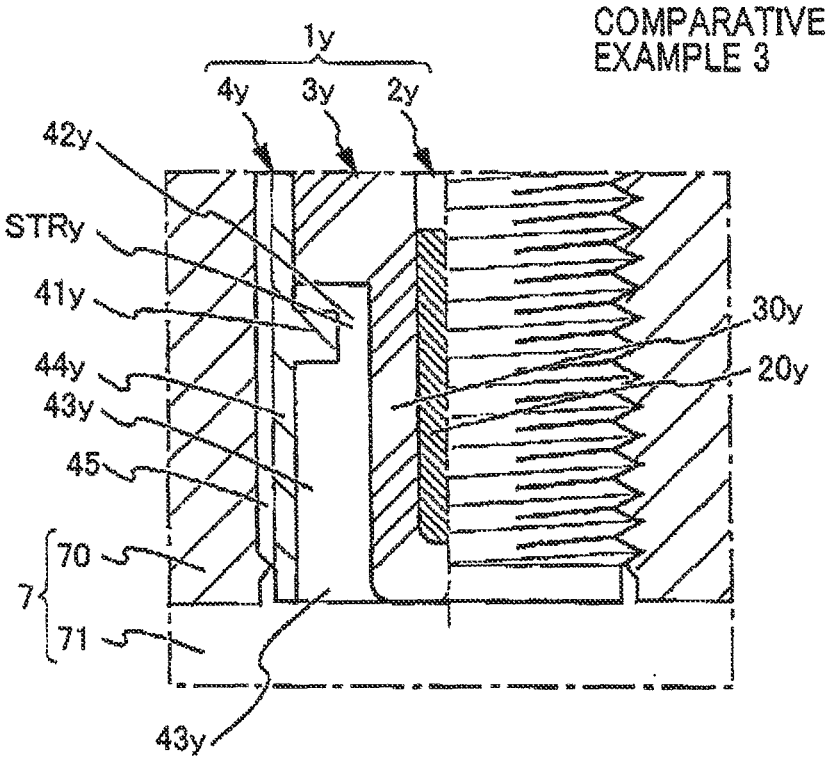
FIG. 5A is a longitudinal cross-sectional view of an ignition device 1*y* as comparative example 2.
Figure 5B:
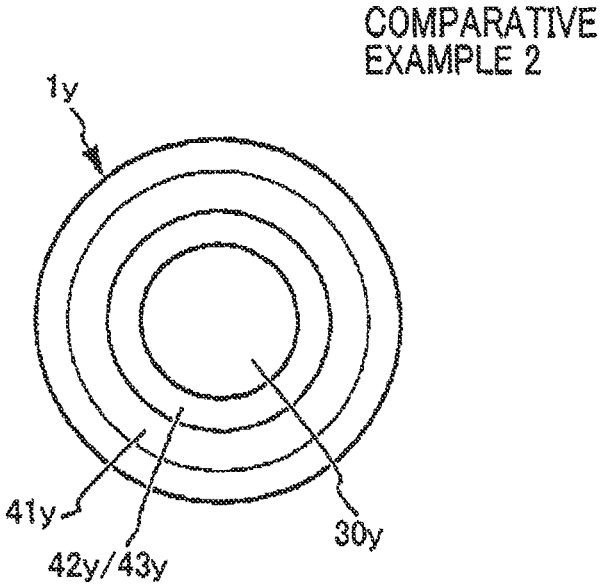
FIG. 5B is a bottom view of the ignition device 1*y* as comparative example 2.

Next, several comparative examples which were fabricated to confirm the advantages of the above described embodiment are explained. FIG. 4A is a longitudinal cross-sectional view of an ignition device 1*x* as comparative example 1. FIG. 4B is a bottom view of the ignition device 1*x*. The ignition device 1*x* includes the center electrode 2X, the center dielectric 3*x* and the housing 4*x*. The discharge space 43*x* is located deep inside the engine head 70. The distal end of the ground electrode 40*x* and the distal end of the center dielectric 3*x* are flush with each other. The ground electrode projecting portion 41*x* is formed in a ring shape projecting radially inward at the distal side of the ground electrode 40*x*. FIG. 5A is a longitudinal cross-sectional view of an ignition device 1*y* as comparative example 2. FIG. 5B, is a bottom view of the ignition device 1*y* as comparative example 2. The ignition device 1*y* includes the center electrode 2*y*, the center dielectric 3*y* and the housing 4*y*. The discharge space 43*y* is located deep inside the engine head 70. The distal end of the ground electrode 40*y* and the distal end of the center dielectric 3*y* are flush with each other. The ground electrode projecting portion 41*y* is formed in a ring shape projecting radially inward, in the back of the discharge space at the proximal side of the ground electrode 40*y*. FIG.

Figure 6A:
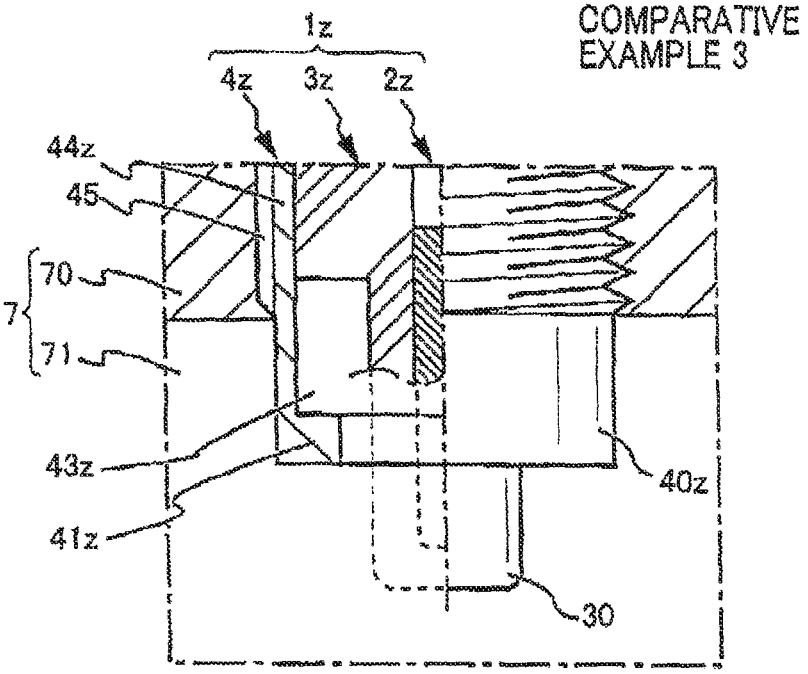
FIG. 6A is a longitudinal cross-sectional view of an ignition device 1*z* as comparative example 3.
Figure 6B:
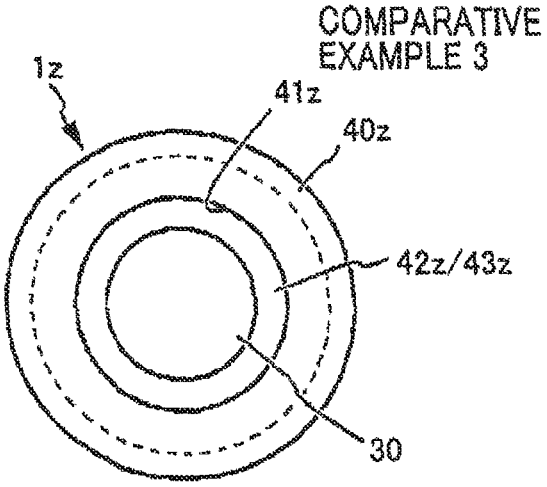
FIG. 6B is a bottom view of the ignition device 1*z* as comparative example 3.

6A is a longitudinal cross-sectional view of an ignition device 1*z* as comparative example 3. FIG. 6B is a bottom view of the ignition device 1*z*. The ignition device 1*z* includes the center electrode 2*z*, the center dielectric 3*z* and the housing 4*z*. The discharge space 43*z* is located deep inside the engine head 70. The distal end of the center dielectric 3*z* is formed so as to project beyond the distal end of the ground electrode 40*z* into the combustion chamber 71. The ground electrode projecting portion 41*z* is formed in a ring shape projecting radially inward at the distal side of the ground electrode 40*y*.

Figure 7A:
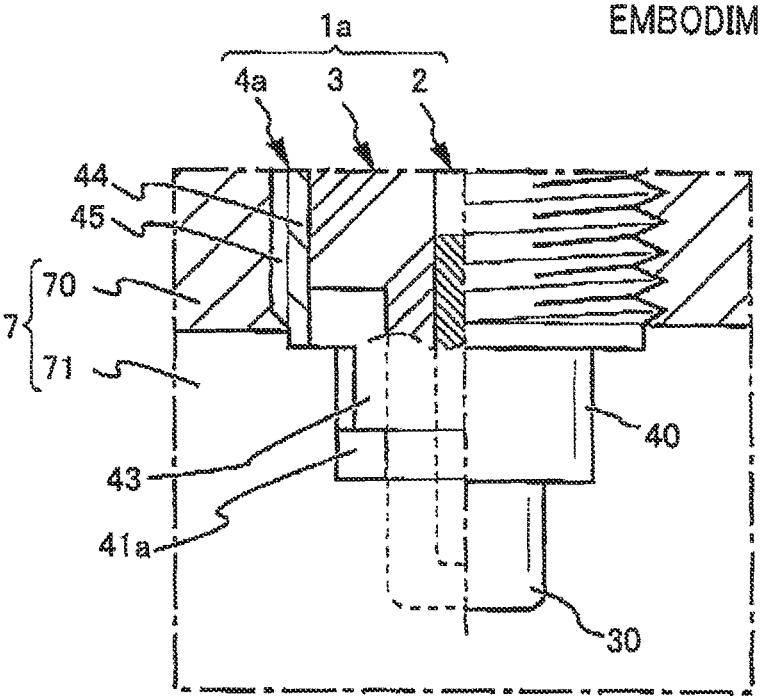
FIG. 7A is a longitudinal cross-sectional view an ignition device 1*a* according to a second embodiment of the invention.
Figure 7B:
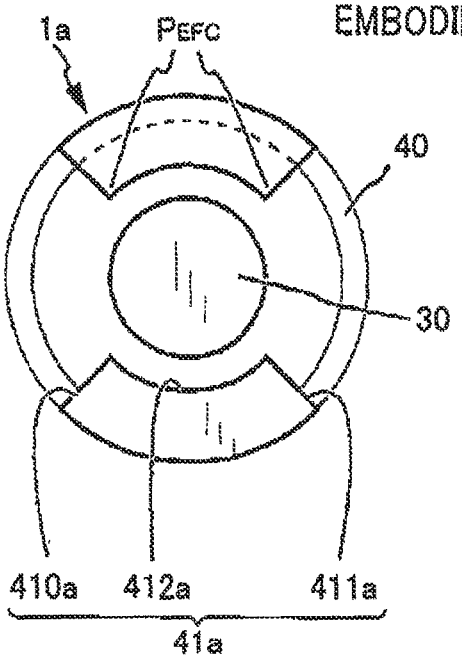
FIG. 7B is a bottom view of the ignition device 1*a* according the second embodiment of the invention.

Next, other embodiments of the invention are described. In the below described embodiments, the same or equivalent components, arts or portions are indicated by the same reference numerals attached with different alphabetical suffixes. FIG. 7A is a longitudinal cross-sectional view of an ignition device 1*a* according to a second embodiment of the invention. FIG. 7B is a bottom view of the ignition device 1*a*. As shown in FIGS. 7A and 7B, the second embodiment differs from the first embodiment in that the distance between the ground electrode projecting portion 41*a*, and the dielectric discharge portion is constant.

Figure 8A:
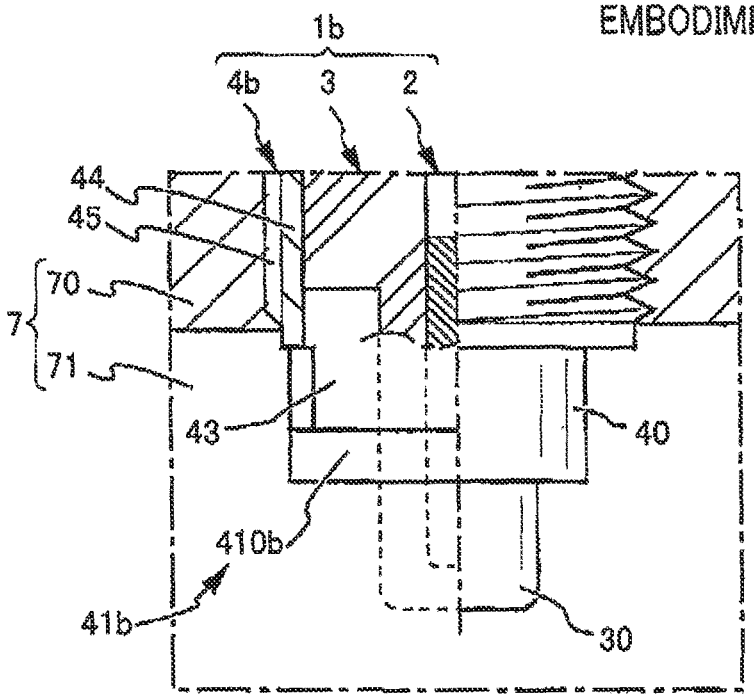
FIG. 8A is a longitudinal cross-sectional view of an ignition device 1*b* according to a third embodiment of the invention.
Figure 8B:
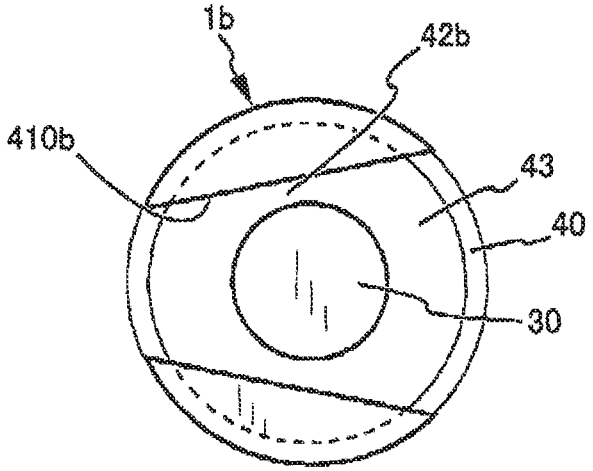
FIG. 8B is a bottom view of the ignition device 1*b* according to the third embodiment of the invention.
Figure 9A:
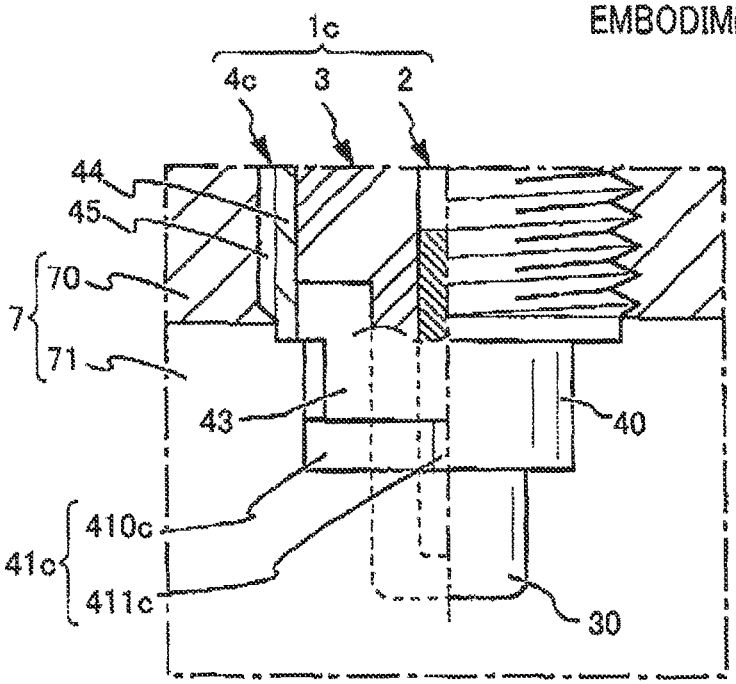
FIG. 9A is a longitudinal cross-sectional view of an ignition device 1*c* according to a fourth embodiment of the invention.
Figure 9B:
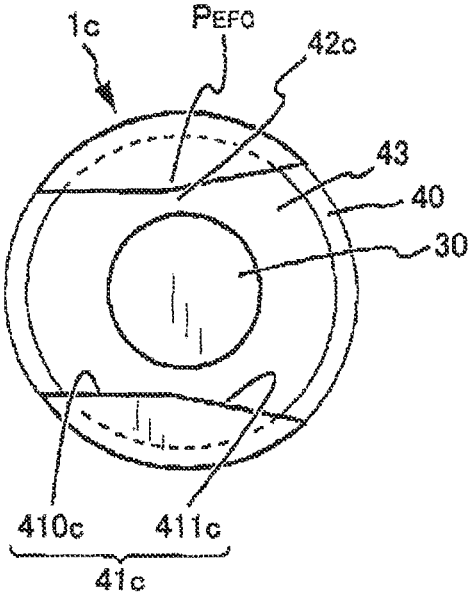
FIG. 9B is a bottom view of the ignition device 1*c* according to the fourth embodiment of the invention.

FIG. 8A is a longitudinal cross-sectional view of an ignition device 1*b* according to a third embodiment of the invention. FIG. 8B is a bottom view of the ignition device 1*b*. As shown in FIGS. 8A and 8B, in this embodiment, the inlet low-straightening surface 410*b* of the ground electrode projecting portion 41*b* is formed in a shape of a flat plane. However, since the surface of the dielectric discharge portion 30 is curved cylindrically, the distance between the ground electrode discharge portion 41*b* and the surface of the dielectric discharge portion 30 is larger at the side of the airflow inlet 400, becomes the minimum at the discharge space narrow portion 42*b* and increases toward the airflow outlet 401. FIG. 9A is a longitudinal cross-sectional view of an ignition device 1*c* according to a fourth embodiment of the invention. FIG. 9B is a bottom view of the ignition device 1*c*. As shown in FIGS. 9A and 9B, in this embodiment, each of the inlet flow-straightening surface 410*c* and the outlet flow-straightening surface 411*c* is formed in a shape of a flat plane. However, a corner portion is present at the position at which the inlet flow-straightening surface 410*c* and the outlet flow-straightening surface 411*c* intersect with each other. This corner portion serves as the electric field concentration portion $P_{EFC}$.

Figure 10A:
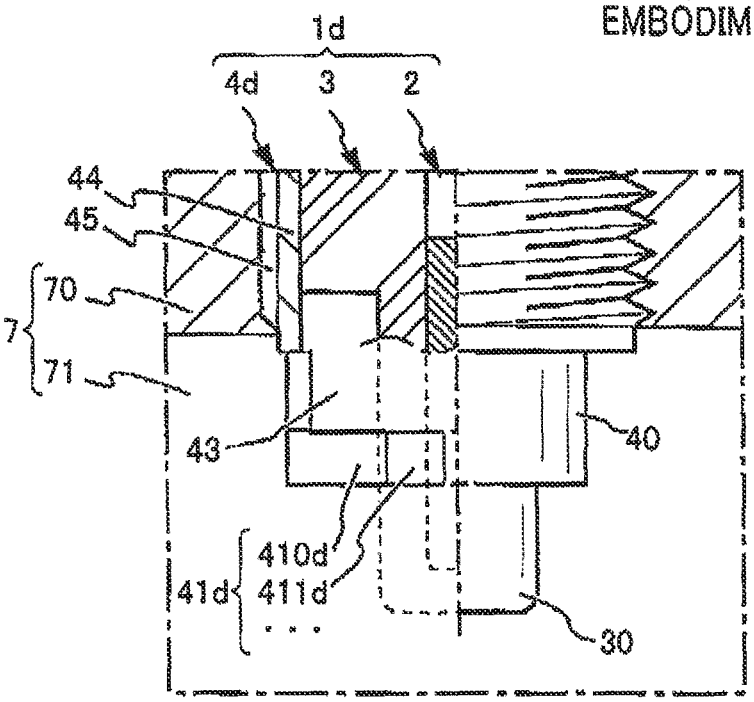
FIG. 10A is a longitudinal cross-sectional view of an ignition device 1*d* according to a fifth embodiment of the invention.
Figure 10B:
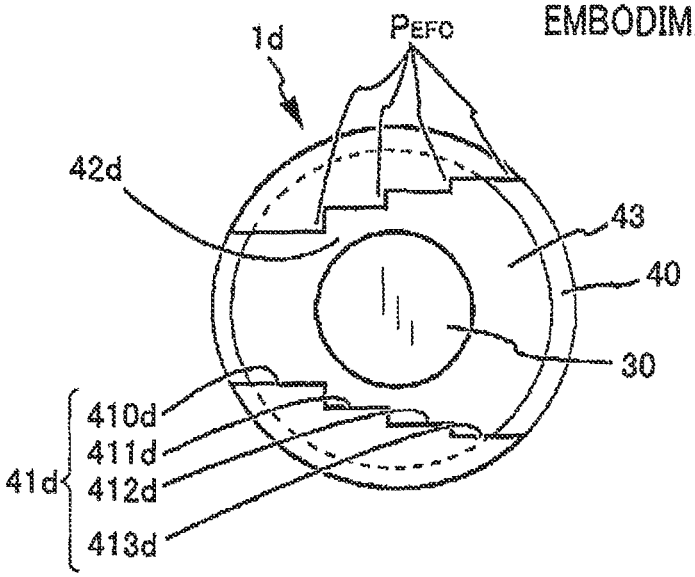
FIG. 10B is a bottom view of the ignition device 1*d* according to the fifth embodiment of the invention.
Figure 11A:
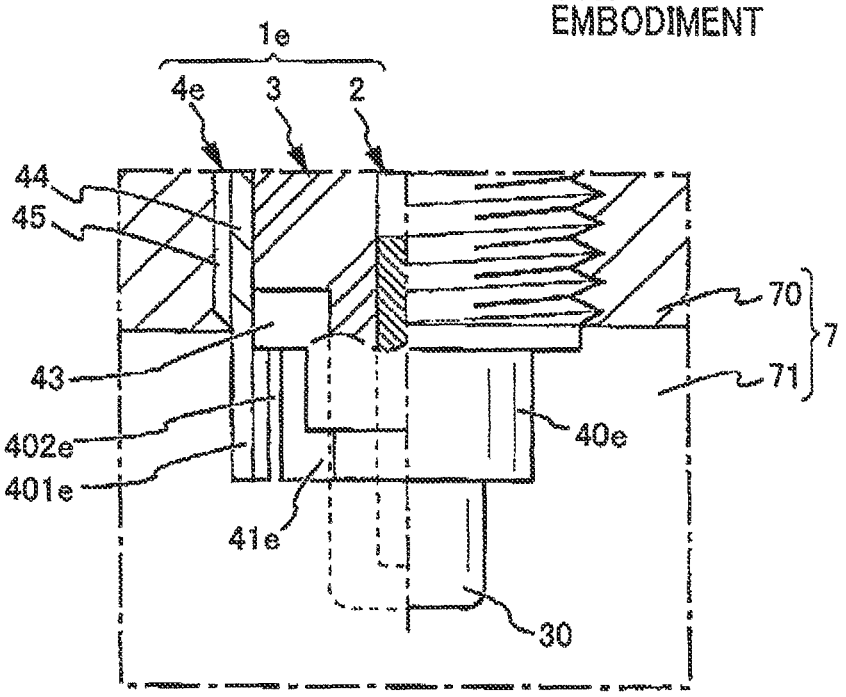
FIG. 11A is a longitudinal cross-sectional view of an ignition device 1*e* according to a sixth embodiment of the invention.
Figure 11B:
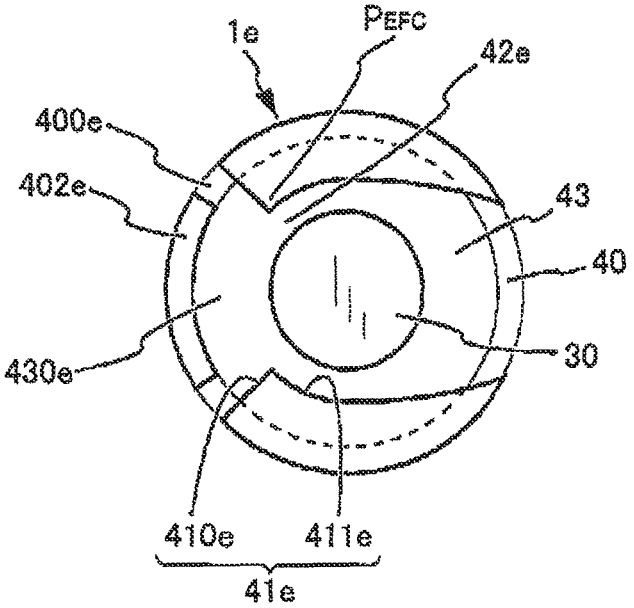
FIG. 11B is a bottom view of the ignition device 1*e* according to the sixth embodiment of the invention.

FIG. 10A is a longitudinal cross-sectional view of an ignition device 1*d* according to a fifth embodiment of the invention. FIG. 10B is a bottom view of the ignition device 1*d*. As seen from FIGS. 10A, and 10B, this embodiment includes the outlet flow-straightening surfaces 411*d*, 412*d* and 413*d* formed in a stepwise shape so that a plurality of corner portions are present to promote concentration of the electric field. FIG. 11A, is a longitudinal cross-sectional view of an ignition device 1*e* according to a sixth embodiment of the invention. FIG. 11B is a bottom view of the ignition device 1*e*. As seen from FIGS. 11A and 11B, in this embodiment, a barrier wall portion 402*e* is provided so as to partly block the airflow inlet 400*e* for suppressing the in-cylinder airflow.

Figure 12A:
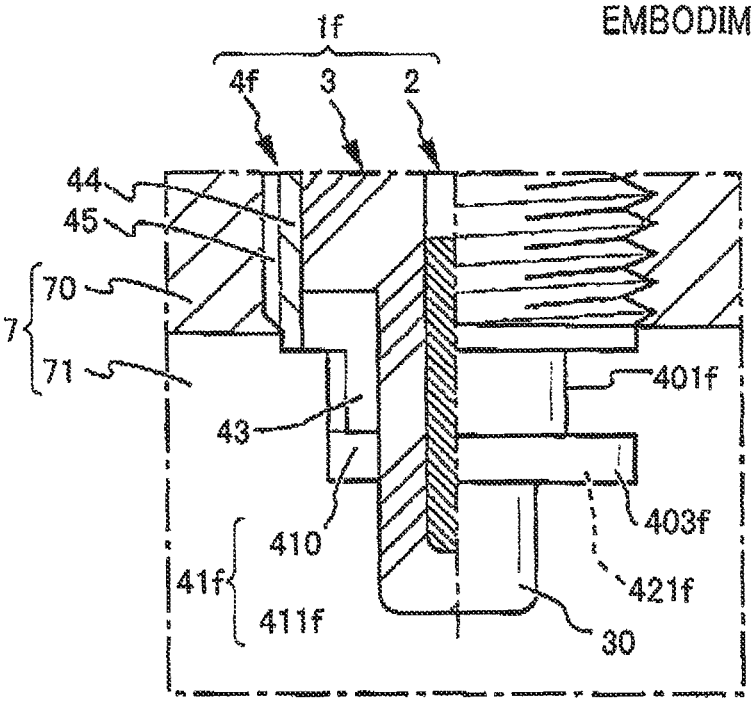
FIG. 12A is a longitudinal cross-sectional view of ignition device 1*f* according to a seventh embodiment of the invention.
Figure 12B:
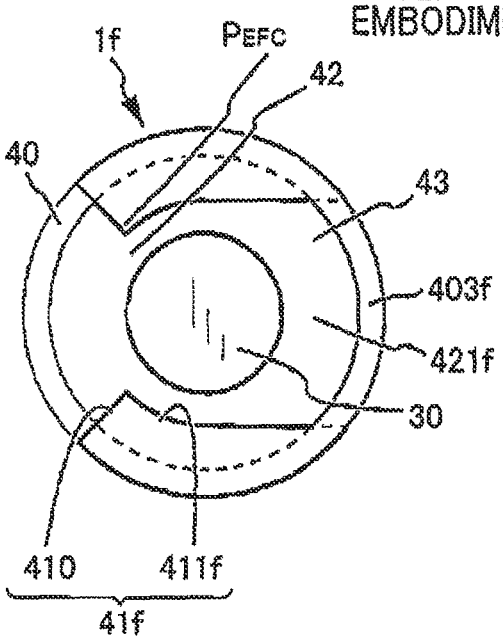
FIG. 12B is a bottom view of the ignition device 1*f* according to the seventh embodiment of the invention.
Figure 13A:
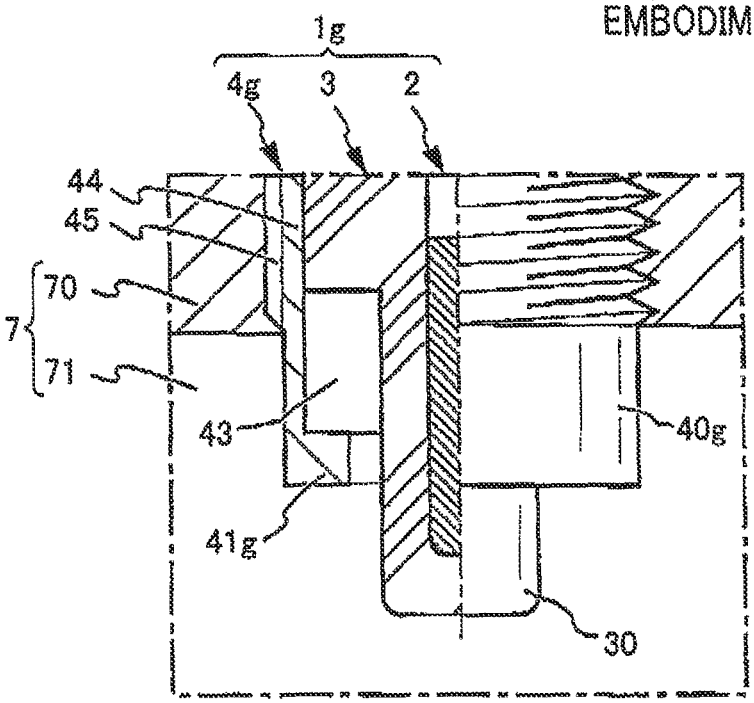
FIG. 13A is a longitudinal cross-sectional view of an ignition device 1*g* according to an eighth embodiment of the invention.
Figure 13B:
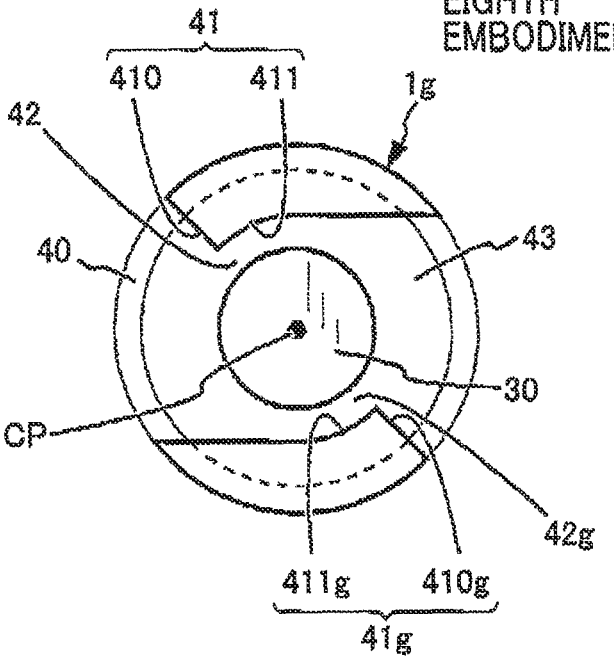
FIG. 13B is a bottom view of the ignition device 1*g* according to the eighth embodiment of the invention.

FIG. 12A is a longitudinal cross-sectional view of an ignition device 1*f* according to a seventh embodiment of the invention. FIG. 12B is a bottom view of the ignition device 1*f*. As seen from FIGS. 12A and 12B, in this embodiment, a barrier wall portion 403*f* is provided so as to partly block the airflow outlet 401*f* for suppressing the in-cylinder airflow. In addition to providing the barrier wall portion 403*f* on the side of the airflow outlet 401*f*, the barrier wall portion 402*e* may be provided on the side of the airflow inlet 400*e*. FIG. 13B is a longitudinal cross-sectional view of an ignition device 1*g* according to an eighth embodiment of the invention. FIG. 13B is a bottom view of the ignition device 1*g*. As shown in FIGS. 13A and 13B, in this embodiment, the ground electrode projecting portion 41*g* is formed in the same shape as that of the first embodiment. However, the pair of the ground electrode projecting portions 41*g* are disposed such that they are symmetrical with respect to the center point CP of the center axis of the center electrode 2.

In this configuration, in one of the ground electrode projecting portions 41*g*, the electric field concentration portion $P_{EFC}$ is always at the upstream side of the in-cylinder airflow, and in the other ground electrode projecting portion 41*g*, the electric field concentration portion $P_{EFC}$ is always at the downstream side of the in-cylinder airflow. In the ground electrode projecting portion 41*g* where the electric field concentration portion $P_{EFC}$ is at the downstream side, the distance by which a streamer discharge STR that has been formed there moves due to the effect of the airflow is small. However, in the other ground electrode projecting portion 41*g*, a streamer discharge STR that has been formed at the electric field concentration portion $P_{EFC}$ there can promote flame growth while moving toward the downstream side along the airflow passing the discharge space narrow portion 42*g*. Accordingly, it becomes unnecessary to align the direction of the opening of the ground electrode projecting portion 41*g* to the in-cylinder airflow direction at the time of screwing the ignition device 1 to the internal combustion engine 7.

Figure 14A:
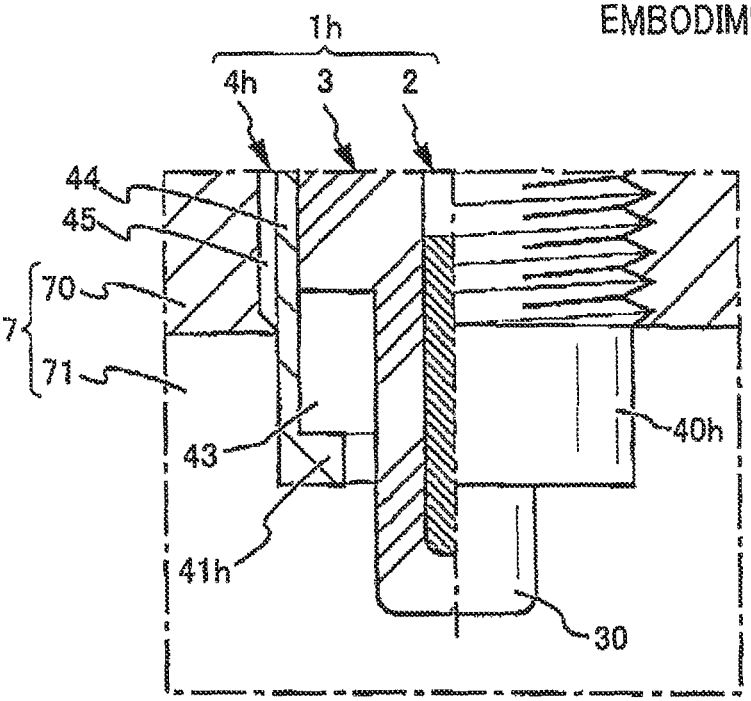
FIG. 14A is a longitudinal cross-sectional view of an ignition device 1*h* according to a ninth embodiment of the invention.
Figure 14B:
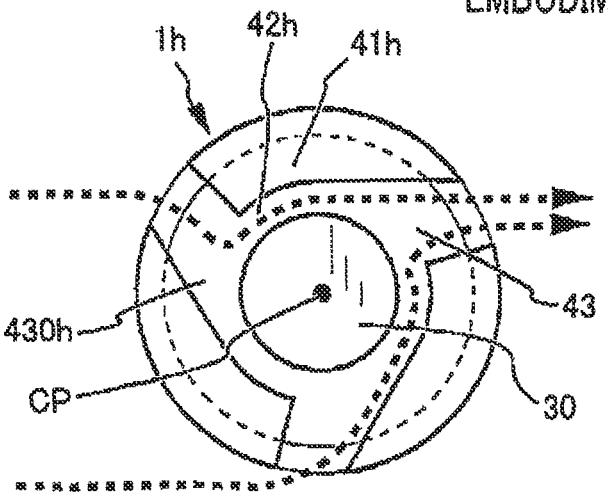
FIG. 14B is a bottom view of the ignition device 1*h* according to the ninth embodiment of the invention.

FIG. 14A is a longitudinal cross-sectional view of an ignition device 1*h* according to a ninth embodiment of the invention. FIG. 14B is a bottom view of the ignition device 1*h*. As shown in FIGS. 14A and 14B, in this embodiment, the ground electrode projecting portion 41*h* is formed in the same shape as that of the first embodiment. However, the three electrode projecting portions 41*h* are disposed evenly around the center axis CP of the center electrode 2. According to this configuration, in one of the three ground electrode projecting portions 41*h*, a streamer discharge STR formed at the electric field concentration portion $P_{EFC}$ promotes flame growth while moving toward the downstream side along the airflow passing the discharge space narrow portion 42*h*, while on the other hand, another one of the three ground electrode projecting portions 41*h* suppresses the in-cylinder airflow to form an airflow stagnation 430*h* for preventing flame blowoff to achieve able ignition.

Figure 15:
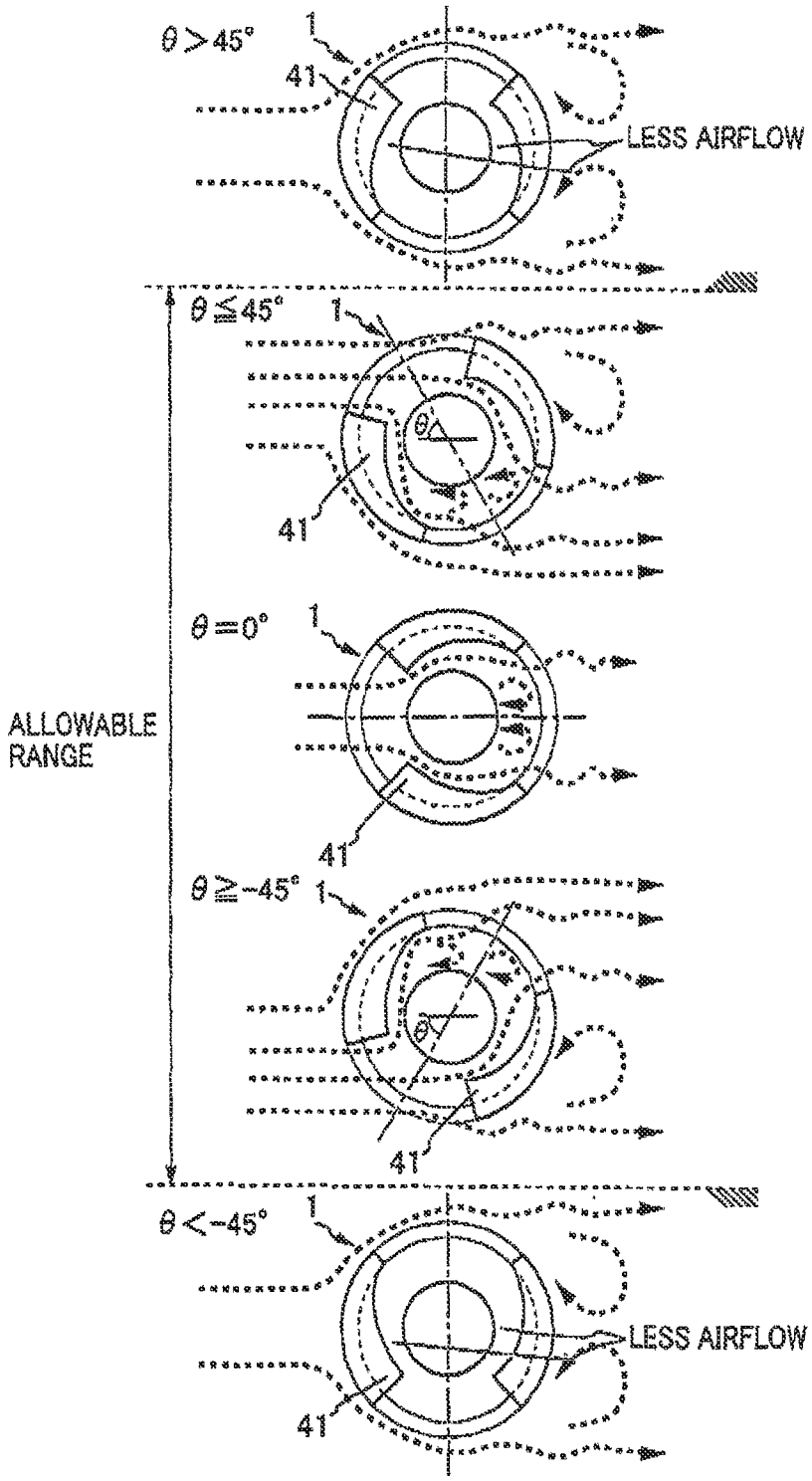
FIG. 15 is a bottom view of the ignition device 1 for explaining an allowable range of the mounting angle of the ignition device 1 with respect to an in-cylinder airflow.

Next, there is explained an allowable angle range in the circumferential direction of the mounting angle θ at the time of mounting the ignition device 1 to the internal combustion engine 7 with reference to FIG. 15. As seen from FIG. 15, when the mounting angle θ between the plane of symmetry of the pair of the ground electrode projecting portions 41 and the direction of the in-cylinder airflow flowing in the combustion chamber 71 is within the range of ±45 degrees, a streamer discharge STR formed by the airflow passing the discharge space narrow portion 42 can promote flame growth while moving toward the downstream side of the in-cylinder airflow.

If the mounting angle θ exceeds a certain range, since the flow velocities in the discharge space 43 and the discharge space narrow portion 42 become very small, and the airflow flows in the axial direction as in comparative example 3 not provided with the airflow inlet 400 or airflow outlet 401, flame growth by movement of the streamer discharge cannot be expected. However, even when the mounting angle θ exceeds the range of ±45 degrees, since the electric field concentration portion PFEC is present in the ground electrode projecting portion 41, the streamer discharge is formed at a low electric field strength compared to comparative example 3. Accordingly, whatever the value of the mounting angle θ is, the ignitability can be maintained more stable compared to comparative example 3 at least when the air-fuel ratio exceeds the lean limit air-fuel ratio.

Next, results of a test which was performed to confirm the advantages of the invention are explained. In this test, the foregoing ignition devices 1, 1*a*, 1*d* of the first, second and fifth embodiments and the foregoing ignition devices 1*x*, 1*y* and 1*z* of comparative examples 1, 2 and 3 were mounted on pressure vessels each simulating an internal combustion engine, and ignition was done using air-propane mixtures having different air-fuel ratios (A/F=20 to 24) to detect a lean limit air-fuel ratio as ignitability for each of the ignition devices 1, 1*a*, 1*d*, 1*x*, 1*y* and 1*z*. This test was performed in an environment hard to ignite where an airflow flowing at the speed of 10 m/s is generated within the pressure vessel.

Figure 16:
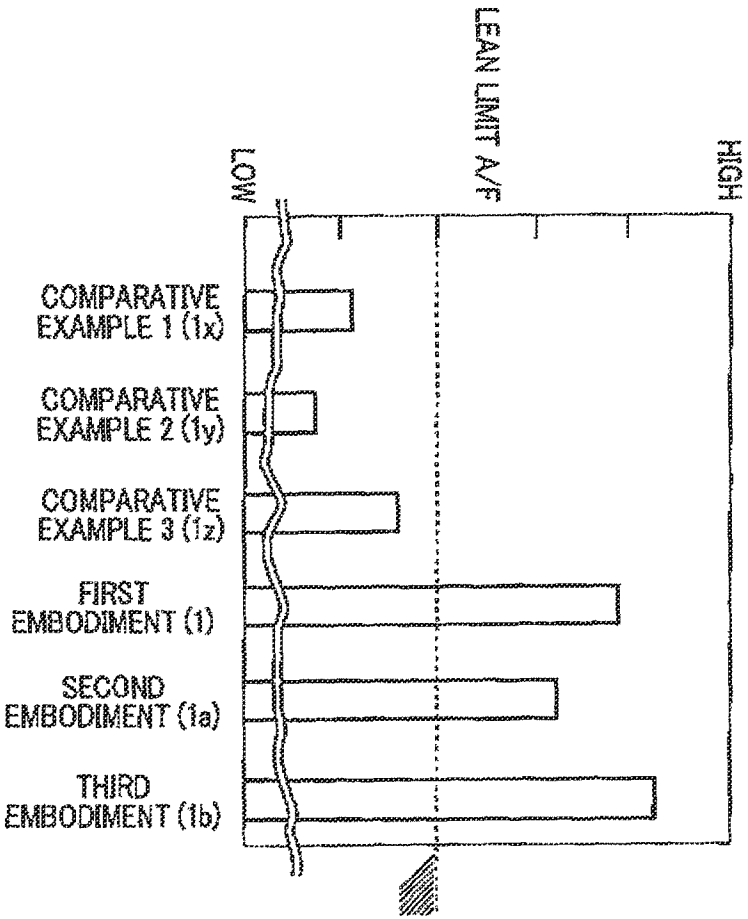
FIG. 16 is a diagram for explaining advantageous effects on limit air-fuel ratio of the embodiments of the invention compared to the comparative examples.

FIG. 16 shows the results of the test. As seen from FIG. 16, the first, second and fifth embodiments of the invention are superior in ignitability, that is, in lean, limit air-fuel ratio to comparative examples 1, 2 and 3. Comparative example 2 is the worst in ignitability. The reason seems to be that since a streamer discharge STR is formed between the center electrode and the ground electrode discharge portion projecting toward the center dielectric in the back of the discharge space, the flame blowoff effect is large.

Comparative example 1 is better in ignitability then comparative example 2 because a streamer discharge is formed at a position closer to the combustion chamber 71 compared to comparative example 2. However, it seems that, since the distal end of the center dielectric 3*x* and the distal end of the ground electrode 40*x* are flush with each other, the speed of the in-cylinder airflow passing over the surface of the ignition device 1*x* is not reduced, and a strong dragging force acts on ions and radicals generated by the streamer discharge causing them to spread in the combustion chamber 71, as a result of which a flame kernel cannot grow sufficiently.

In comparative example 3, since the ground electrode projecting portion 41*z* faces the dielectric discharge portion 30 at the distal end of the ground electrode 40*z*, and the dielectric discharge portion 30 projects beyond the distal end of the ground electrode 40*z* into the combustion chamber 71, a streamer discharge STR is formed at a position at which a reaction with the air-fuel mixture within the combustion chamber 71 can occur easily to promote a volume ignition, as a result of which the lean limit air-fuel ratio becomes high compared to comparative examples 1 and 2. On the other hand, the first embodiment of the invention has, in addition to the advantage of comparative example 3, the advantage that, since a generated streamer discharge STR is drifted by the airflow passing the discharge space 43 and the discharge space narrow portion 42 wile being reduced in velocity by the inlet flow-straightening surface 410 and the outlet flow-straightening surface 411, flame growth is promoted as a result of which the lean limit air-fuel ratio becomes high.

The lean limit air-fuel ratio of the second embodiment is higher than that of comparative example 3, but lower than that of the first embodiment. This seems to be because the distance between the ground electrode projecting portion 41*a* and the dielectric discharge portion 30 is constant causing the airflow to be uniform, as a result of which agitation between the flame kernel and the air-fuel mixture is insufficient. However, it was found that the extent of the advantage of the second embodiment does not vary much with the mounting angle θ of the ignition device 1*a*. It was found that the lean limit air-fuel ratio of the fifth embodiment is the highest. This seems to be because, since a plurality of the corner portions are present, and a streamer discharge can be formed easily at each of their respective electric concentration portions $P_{EFC}$, the discharge energy that can be used for flame growth is large. However, the fifth embodiment requires a relatively larger amount of labor hour for machining the ground electrode projecting portion 41.

The second embodiment is inferior in the lean limit air-fuel ratio to other embodiments. However, the second embodiment has the advantage that it is not necessary to adjust the mounting angle θ of the ignition device in accordance with the in-cylinder airflow unlike the first and fifth embodiments. Hence, it is preferable to select from the ignition devices of the various embodiments of the invention in accordance with their advantages and disadvantages, the cost and the characteristic of an object internal combustion engine.

The above explained preferred embodiments are exemplary of the invention of the present application which is described solely by the claims appended below. It should be understood that modifications of the preferred embodiments may be made as would occur to one of skill in the art.

What is claimed is:

1. An ignition device for an internal combustion engine comprising:

a columnar center electrode;

a center dielectric having a shape of a bottomed cylinder and covering the center electrode;

a housing accommodating therein the center dielectric;

a ground electrode disposed at a distal end of the housing so as to form a discharge space with the center dielectric; and a high energy source for applying an AC voltage of a predetermined frequency between the center electrode and the ground electrode so that an AC electric field is formed between the center electrode covered by the center dielectric and the ground electrode to generate a streamer discharge for igniting an air-fuel mixture introduced into a combustion chamber of the internal combustion engine;

wherein a distal end portion of the center electrode covered by the center dielectric projects beyond a distal end of the ground electrode to an inside of the combustion chamber to make a dielectric discharge portion exposed in the discharge space, the ground electrode is formed with an airflow inlet and an airflow outlet at lateral portions thereof for enabling an in-cylinder airflow flowing in the combustion chamber to be introduced into the discharge space, and a distal end portion of the ground electrode projects radially inward to make at least one ground electrode projecting portion so that a discharge space narrow portion is formed between the at least one ground electrode projecting portion and the dielectric discharge portion.

2. The ignition device for an internal combustion engine according to claim 1, wherein each of the at least one ground electrode projecting portion includes an inlet flow-straightening surface, a distance between the inlet flow-straightening surface and the dielectric discharge portion decreasing toward a downstream side of the in-cylinder airflow, and an outlet flow-straightening surface located downstream from the discharge space narrow portion, a distance between the outlet flow-straightening surface and the dielectric discharge portion increasing toward the downstream side of the in-cylinder airflow.

3. The ignition device for an internal combustion engine according to claim 2, wherein the distance between the outlet flow-straightening surface and the dielectric discharge portion increases gradually in a continuous manner toward the downstream side of the in-cylinder airflow.

4. The ignition device for an internal combustion engine according to claim 2, wherein the distance between the outlet flow-straightening surface and the dielectric discharge portion increases stepwise toward the downstream side of the in-cylinder airflow.

5. The ignition device for an internal combustion engine according to claim 1, wherein the ground electrode projecting portion includes a barrier wall portion located at least at one of a side of the airflow inlet and a side of the airflow outlet.

6. The ignition device for an internal combustion engine according to claim 1, wherein the at least one ground electrode projecting portion comprises two ground electrode projecting portions located at each of two different positions so as to be symmetric with respect to an imaginary plane including a center axis of the center electrode.

7. The ignition device for an internal combustion engine according to claim 6, wherein an angle between the imaginary plane and a direction of the in-cylinder airflow is in a range of ±45 degrees.

8. The ignition device for an internal combustion engine according to claim 1, wherein the at least one ground electrode projecting portion comprises two ground electrode projecting portions located at each of two different positions so as to be point-symmetrical to one another with respect to a center axis of the center electrode.

9. The ignition device for an internal combustion engine according to claim 1, wherein the at least one ground electrode projecting portion comprises three ground electrode projecting portions located at each of three different positions so as to be disposed evenly around the center axis of the center electrode.

* * * * *